United States Patent [19]

Gosselin

[11] 4,112,985

[45] Sep. 12, 1978

[54] HYDRAULIC LOG SPLITTER IMPLEMENT

[76] Inventor: Yvon Gosselin, 11e rang, R.R. 1, Plessisville, Canada

[21] Appl. No.: 779,420

[22] Filed: Mar. 18, 1977

[30] Foreign Application Priority Data

Mar. 22, 1976 [GB] United Kingdom ..... 11367/76

[51] Int. Cl.[2] ..... B27L 7/00

[52] U.S. Cl. ..... 144/193 A; 144/193 K; 254/124

[58] Field of Search ..... 144/3 K, 193 R, 193 A, 144/193 C, 193 D, 193 E, 193 K; 254/104, 124; 269/211, 212, 238

[56] References Cited

U.S. PATENT DOCUMENTS

| | | | |
|---|---|---|---|
| 205,550 | 7/1878 | Hildreth | 144/193 K |
| 280,657 | 7/1883 | Mors et al. | 144/193 K |
| 629,144 | 7/1899 | Wise | 144/193 K |
| 2,493,914 | 1/1950 | Corey et al. | 144/193 R |
| 3,059,785 | 10/1962 | Buckeye | 254/124 X |
| 3,285,304 | 11/1966 | Fuller | 144/193 A |
| 3,760,854 | 9/1973 | Worthington | 144/193 A |
| 3,779,295 | 12/1973 | Balsbaugh | 144/193 A |
| 3,834,436 | 9/1974 | Burkett | 144/193 A |
| 3,842,871 | 10/1974 | Jureiwicz | 144/193 A X |

FOREIGN PATENT DOCUMENTS

| | | | |
|---|---|---|---|
| 453,780 | 12/1940 | Italy | 144/193 X |

*Primary Examiner*—Othell M. Simpson
*Assistant Examiner*—W. D. Bray

[57] ABSTRACT

An hydraulic log splitter in the form of an implement securable to the three-point hitch at the rear of a vehicle or tractor and in which is distinctively adapted to remain attached to the vehicle without hindering normal towing function thereof, which uses the leverage benefit of a lever arm between the hydraulic cylinder and the splitting wedge, which may be operated by a single person, and is adjustable in relation to the length of logs to be splitted. This log splitter implement comprises an upstanding portion, teeth upwardly spaced apart along the upstanding portion, a lower portion adjustably resting on one of these teeth, a lever arm pivoted to the upper end of the upstanding portion, a splitting wedge fixed to the lever arm and overlying the lower portion, an hydraulic cylinder and a valve operating the lever arm to split a log resting upright on this lower portion.

1 Claim, 3 Drawing Figures

HYDRAULIC LOG SPLITTER IMPLEMENT

This invention relates to a log splitting implement of the type connected to and powered by a vehicle such as a tractor having a three-point hitch as now provided on most farm tractors.

A log splitting implement of the above type has so far been proposed, however such implement need to be disconnected and removed to allow hitching and towing of some other equipment by the tractor. This is due to the fact that in these preceding log splitting implements, the log longitudinally extends in the lengthwise direction of the tractor for the splitting operation. Another disadvantage of such preceding log splitting implement is that the shearing force constitutes the mere force produced by the hydraulic cylinder.

It is a general object of the present invention to provide an hydraulic log splitting implement which may remain in position of attachment to the vehicle and still allow normal use of the latter for towing some other equipment.

It is a more specific object of the present invention to provide an hydraulic log splitting implement wherein the log longitudinally extend in upright position for the splitting operation and thus produces a compact arrangement at the rear of the vehicle or tractor.

It is another object of the present invention to provide an hydraulic log splitting implement wherein a lever arm action is used between the hydraulic cylinder action and the splitting head or wedge to benefit from the leverage thus attained.

It is a further object of the present invention to provide an hydraulic log splitting implement which may be operated by a single person and which is adjustable to accommodate logs of different lengths.

The above and other objects and advantages of the present invention will be better understood with reference to the following detailed description of a preferred embodiment thereof which is illustrated, by way of example, in the accompanying drawing; in which.

Figure 1:
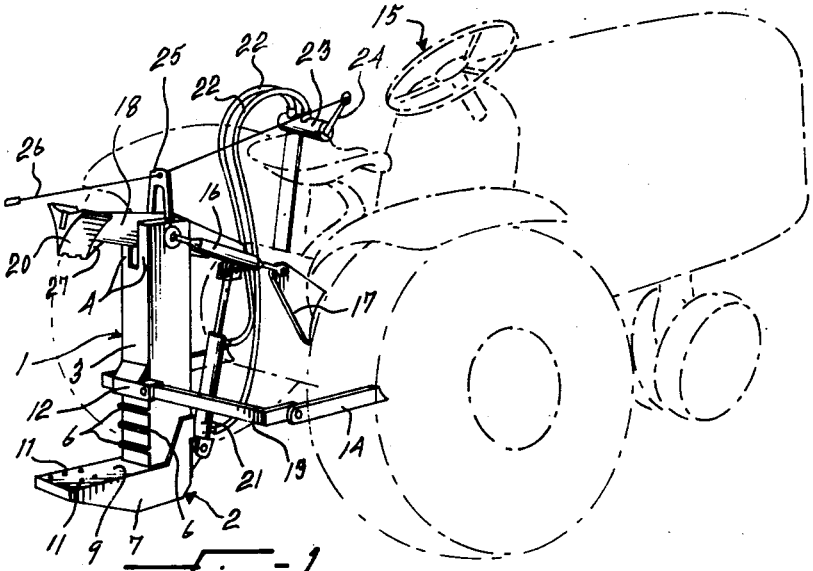
FIG. 1 is a perspective view of an hydraulic log splitter implement according to the present invention.

The illustrated log splitter implement comprises a body 1 including a lower portion 2 and an upstanding portion 3 relative to the lower portion. The upstanding portion 3 is of rectangular substantially uniform cross section at least in its lower part and has a slotted upper end defining laterally spaced apart upward projections 4. The lower end of the upstanding portion 3 is closed by a baseplate 5. A series of adjustment teeth 6 are provided on the rear face of the upstanding portion 3 and are laterally spaced apart from each other upwardly along the upstanding portion.

The lower portion 2 is a log support formed of metal plates defining a collar consisting of laterally spaced apart side plates 7 straddling the upstanding portion 3 on laterally opposite sides thereof and of a transverse plate 8 which interconnects the two side plates 7 and operatively abuts flat against the forward face of the upstanding portion 3. The lower portion 3 also includes a top plate 9 rigidly interconnecting the two side plates 7 and having a forward edge selectively resting on one of the adjustment teeth 6. Transverse plate 8 is at a higher level than top plate 9. The latter is thus held in cantilever fashion on upstanding body portion 3 by plate 8 and by the forward edge of top plate 9. It may thus be seen that the lower portion 2 may be selectively adjusted up or down by resting on one or another of the adjustment teeth 6. This is done by upwardly tilting the rear end of the lower portion 2, sliding it either upward or downward, and then resting it on the selected adjustment teeth 6. As will be better understood later, this allows to adjust for logs 10 of different lengths. The upper face defined by the top plate 9 is made rough by upwardly projecting studs 11. This produces an anti-slippery face on which one end of the log 10 is rested.

A bracket 12 is rigidly fixed against the rear face of the upstanding portion 3. A rigid crossbar is connected to the bracket 12 in carrying relationship relative to the upstanding portion 3. The crossbar 13 projects from the opposite sides of the upstanding portion 3 and forms a pair of forwardly projecting portions which pivotally connect to the pair of hitch links 14 of the three-point hitch of the tractor 15. A strut 16 is pivotally connected to the upper end of the upstanding portion 3 and to a third hitch link 17 of the tractor.

Figure 2:
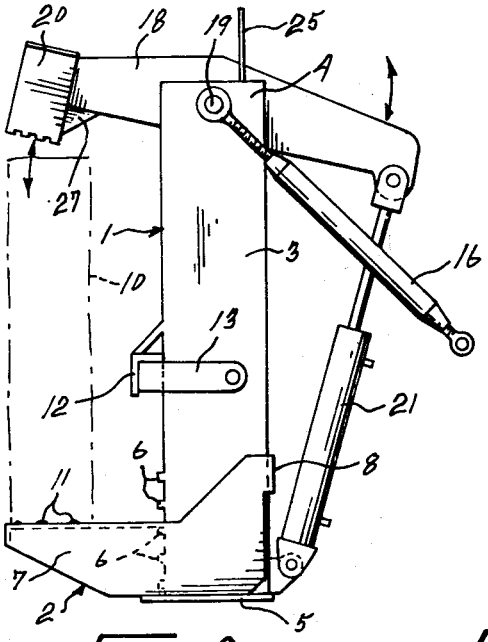
FIG. 2 is a side view of the log splitter implement of FIG. 1.
Figure 3:
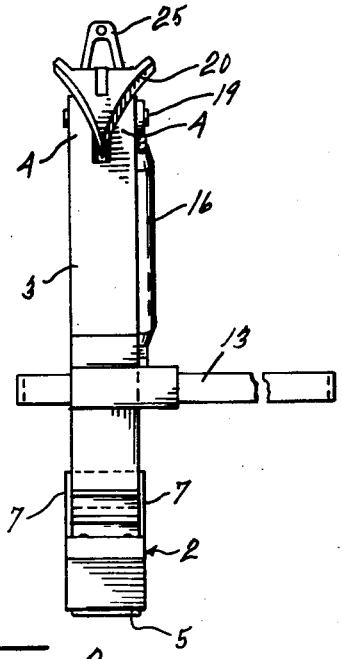
FIG. 3 is a rear view of the same log splitter implement.

A lever arm 18 of heavy gauge metal is pivoted by a cross pin 19 between the laterally spaced apart upward projections 4. The lever arm 18 has a log splitting wedge 20 fixed to the end thereof rearward of the upstanding portion 3. The splitting wedge 20 is arranged in overlying relationship relative to the top plate 9 to strike on the upper end of a log 10 resting upright on the studs 11, as shown in FIG. 2.

An hydraulic cylinder 21 is connected to the forward end of the lever arm 18 and to the lower end of the upstanding portion 3 to operatively and reciprocatively pivot the lever arm 18 and thus produce downward splitting action of the splitting wedge 20. The hydraulic cylinder 21 is connected by a pair of hydraulic fluid lines 22 to a pair of outlets of a control valve 23. The latter is positioned forward of the log splitting implement within reach by the driver of the tractor. A manual control lever 24 is connected for operation of the valve 23 by the driver of the tractor.

A support 25 is fixed to the upper end of the upstanding portion 3 and a push rod 26 is slidably threaded and supported by the support 25 and connected to the control lever 24 to allow control of the latter and the whole log splitting operation to be performed by a single person at the rear of the tractor to put the logs on the top plate 9.

It must be appreciated that complete implement is very compact or of little encumbrance against the rear of the tractor and it allows to hitch and tow some other equipment with the same tractor while in position at the rear of the latter.

A shearing edge or cutter 27 is fixed against the lower edge of the lever arm 18 adjacent the splitting wedge 20 to assist the shearing action of the latter.

Splitting wedge 2 has a V shape, when seen in front elevation, with concave side faces to split the log open with a minimum stroke and least force of cylinder 21. As the wedge enters the log, the splitting force required rapidly diminishes and, therefore, the two wings progressively become more inclined to each other to widen the split in the log as an experimental function of the piston stroke in which the exponent is greater than unity.

I claim:

1. A hydraulic log splitter implement comprising an elongated upstanding body portion, a pair of connectors secured at upwardly spaced-apart positions along said upstanding body portion and pivotally securable to a three-point hitch system of a farm tractor, a log support carried by said body portion, a splitting wedge movably carried by said upstanding body portion for movement toward and away from said log support, power means to cause movement of said splitting wedge, said wedge defining a thin edge directed toward said log support for splitting engagement of said splitting wedge into the upper end of a log positioned upright on said log support, said log support being upwardly adjustable along said upstanding body portion to a selected height below the splitting wedge in relation to the length of the logs to be split and wherein said upstanding body portion has a rectangular or square cross-section substantially uniform along its lower part, adjustment teeth serially spaced apart upwardly along a face of said lower part, and said log support includes a top substantially horizontal plate having an edge selectively resting on one of said adjusting teeth, and a collar member secured to said top plate, surrounding said body portion and including a collar part slidably engaging a second face of said lower part opposite to said first-named face, said collar part being at a higher level than said top plate and the latter being held in cantilever fashion on said body portion by said collar part and by said edge of said top plate.

* * * * *